US006484546B1

(12) United States Patent
Hovestädt

(10) Patent No.: US 6,484,546 B1
(45) Date of Patent: Nov. 26, 2002

(54) STRIP DEFLECTION ROLLER, ESPECIALLY A TENSION MEASURING ROLLER OR LOOPER ROLLER

(75) Inventor: Erich Hovestädt, Rhede (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/763,297

(22) PCT Filed: Aug. 19, 1999

(86) PCT No.: PCT/DE99/02643

§ 371 (c)(1),
(2), (4) Date: Feb. 20, 2001

(87) PCT Pub. No.: WO00/10745

PCT Pub. Date: Mar. 2, 2000

(30) Foreign Application Priority Data

Aug. 20, 1998 (DE) ..... 198 38 675

(51) Int. Cl.[7] ..... B21B 37/48

(52) U.S. Cl. ..... 72/8.6; 72/11.4

(58) Field of Search ..... 72/8.3, 8.6, 8.7, 72/9.1, 11.1, 11.4, 11.7, 12.3, 205, 365.2; 73/826, 829, 862.07

(56) References Cited

U.S. PATENT DOCUMENTS

| | | | | | |
|---|---|---|---|---|---|
| 4,116,029 | A | * | 9/1978 | Fabian et al. | 72/8.3 |
| 4,188,809 | A | * | 2/1980 | Ishimoto et al. | 72/11.4 |
| 4,289,005 | A | * | 9/1981 | Cabaret et al. | 72/8.7 |
| 4,674,310 | A | * | 6/1987 | Ginzburg | 72/11.4 |
| 5,379,631 | A | * | 1/1995 | Kira et al. | 72/11.1 |

FOREIGN PATENT DOCUMENTS

| | | | | |
|---|---|---|---|---|
| JP | 1-148411 | * | 6/1989 | 72/11.4 |
| JP | 1-262012 | * | 10/1989 | 72/8.7 |
| SU | 1184576 | * | 10/1985 | 72/8.6 |

* cited by examiner

*Primary Examiner*—Ed Tolan
(74) *Attorney, Agent, or Firm*—Cohen, Pontani, Lieberman & Pavane

(57) ABSTRACT

A strip deflection roller, especially a tension measuring roller or looper roller for matching tension in rolling stock between two roll stands for hot rolling and cold rolling of strip. The strip deflection roller includes at least five adjacent disks which are mounted on a common eccentric shaft so as to be freely rotatable independently. At most two of the disks are mounted concentric to the axis of rotation of the eccentric shaft, and the height positions of the rest of the disks can be changed for influencing the profile and regulating the flatness of the strip guided over the strip deflection roller by rotating the eccentric shaft.

10 Claims, 2 Drawing Sheets

STRIP DEFLECTION ROLLER, ESPECIALLY A TENSION MEASURING ROLLER OR LOOPER ROLLER

BACKGROUND OF THE INVENTION

The invention is directed to a strip deflection roller, especially a tension measuring roller or looper roller for matching tension in rolling stock between two roll stands for hot rolling and cold rolling of strip.

Tension measuring rollers or looper rollers are used in hot rolling mills and cold rolling mills, for example, between two four-high stands and normally serve for tension matching between stands. In cold rolling, the tension measuring roller is moved to a fixed position and, by means of the force transmitted to the tension measuring roller by the strip tension via the strip, tension matching is achieved by means of suitable measurement sensors by adapting the rolling speed of the stands. In hot rolling, looper rollers are used to form loops in the strip for tension matching, wherein the looper position, i.e., its height position, is a measure for the looped strip reserve between the stands. In matching the speeds of the stands, it is attempted to keep the strip reserve, and therefore the looper position, within a determined area.

SUMMARY OF THE INVENTION

It is impossible to correct the strip tension along the strip width in the tension measuring rollers and cylindrical looper rollers used in the prior art. Since regulation of profile and flatness is indispensable in modern rolling mills of the type described above, it is the object of the present invention to use the tension measuring rollers or looper rollers for matching tension in rolling stock between two roll stands also as means for regulating profile and flatness. This requires a special construction of the strip deflection rollers.

To meet this object, it is suggested according to the invention that the strip deflection roller comprises at least five adjacent disks which are mounted on a common eccentric shaft so as to be freely rotatable independently from one another, at most two of these disks being mounted concentric to the axis of rotation of the shaft, and the height positions of the rest of the disks can be changed for influencing the profile and regulating the flatness of the strip guided over the strip deflection roller by means of rotating the eccentric shaft.

The diameters of the disks can be identical or may vary. With appropriate selection of the disk diameter and eccentricity of the eccentric shaft, the outer contour of the strip deflection roller can be adjusted by rotation of the stepper motor continuously from a concave profile to a parallel profile to a convex profile, so that the flatness and, if required, the profile of the strip guided over the roller can be corrected.

It is advantageously provided that the eccentric shaft can be driven in rotation continuously by a stepper motor acting on the axle of the shaft.

According to the invention, for use in roll stands for cold rolling of strip, the strip deflection roller is moved to a fixed position relative to the strip which is deflected under tension and the desired flatness correction is adjusted by rotating the eccentric shaft axle. In this regard, the flatness correction is limited by the geometry of the strip deflection roller and the adjusted tension.

When the invention is applied in roll stands for the hot rolling of strip, the strip deflection roller is used as a looper roller, as it is called, and its height position is adjusted to compensate for speed differences in the two stands, the desired flatness correction likewise being adjusted by rotating the eccentric shaft axle.

Accordingly, in contrast to cold rolling mills, the strip deflection roller is not moved to a fixed position in the hot rolling mill, but, rather, by forming a strip reserve between two stands, serves as a looper for compensating for speed differences between the stands. As a result, there are variations in the height of the looper and differences in the relative elongation or strain depending on the looper height. These differences can be corrected by changing the strip deflection roller profile in continuous manner in that the stepper motor adjusts the appropriate strip deflection roller position by rotating the eccentric shaft.

In an advantageous construction of the invention, it is suggested that the strip deflection roller is used simultaneously as a tension measuring roller by outfitting it with suitable known measurement transmitters.

The invention is described in the following by means of an embodiment.

DETAILED DESCRIPTION OF THE PREFERRED EMBODIMENTS

Figure 1:
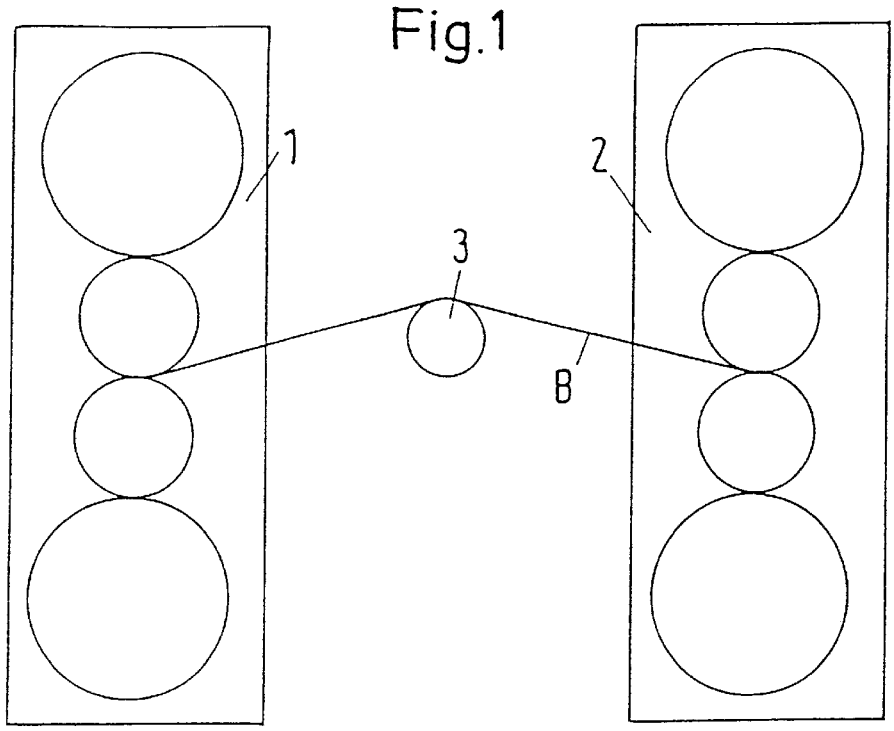
FIG. 1 shows the arrangement of the strip deflection roller, according to the invention, between two four-high roll stands.
Figure 2:
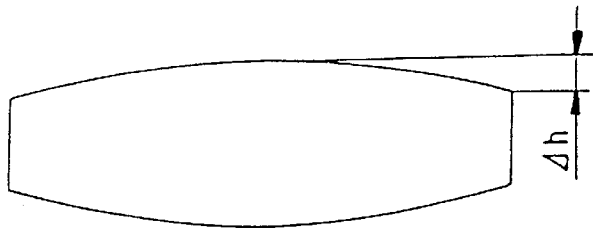
FIG. 2 shows a convex measuring roller.
Figure 3:
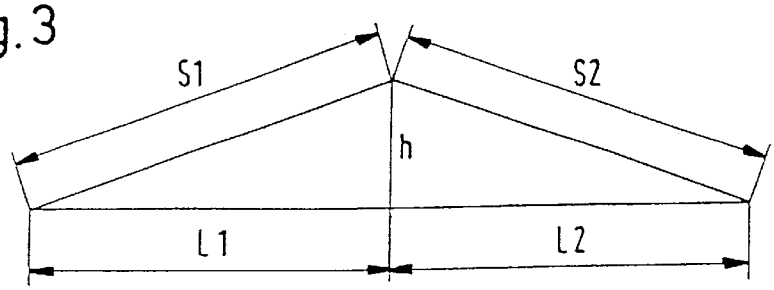
FIG. 3 shows a geometric model of the strip shape for the strip edge.
Figure 4:
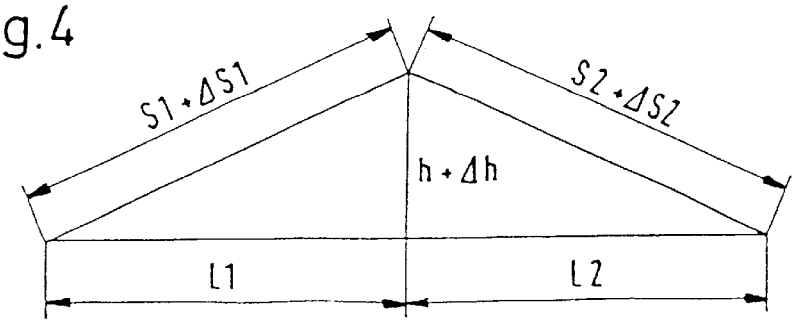
FIG. 4 shows the geometric model of the strip shape for the strip center.

For purposes of illustrating the invention, a model will first be considered in which the strip deflection roller 3 according to the invention is arranged between two four-high stands 1 and 2 (FIG. 1). A convex measuring roller is assumed (FIG. 2) to illustrate the path difference and elongation difference between the center of the strip and the edges of the strip. FIG. 3 shows the geometric model of the strip shape for the strip edge; FIG. 4 shows the corresponding relationships for the center of the strip. To simplify without limiting generality, it is assumed for the purposes of this example that the strip width and strip deflection roller are identical. The following designations are selected herein:

- $s_1$ path of the strip between the four-high stands and the top edge of the strip deflection roller
- $s_2$ path of the strip between the top edge of the strip deflection roller and the four-high stand 2
- $\Delta s_1$ additional path traveled by the strip center between the four-high stand 1 and the top edge of the strip deflection roller
- $\Delta s_2$ path traveled by the strip center relative to the strip edge between the top edge of the strip deflection roller and the four-high stand 2
- $L_1$ horizontal distance between the four-high stand 1 and the strip deflection roller
- $L_2$ horizontal distance between the center of the strip deflection roller and the four-high stand 2 h top edge of looper height in relation to the top edge of the upper work roller h (pass line)

Δh convexity of looper, i.e., difference in radius between the center of looper and the height of looper edge x $s_1+S_2$ Δx $\Delta S_1+\Delta S_2$ $\epsilon\Delta x/x=(\Delta s_1+\Delta s_2)/(s_1+s_2)$ When the paths of the strip for the strip center and the strip edge are calculated by means of the relationships selected in FIGS. 3 and 4 under the simplifying assumption of a linear strip shape, then the elongations Δ listed in the following table are given for the numerical example:

$x_1$=2000 mm, $x2$=3000 mm, $\Delta h$=5 mm as a function of the height of the strip deflection roller over the pass line:

| h | $\epsilon \times 10^{-6}$ |
|---|---|
| 5 | 2.1 |
| 55 | 43.75 |
| 105 | 85.27 |
| 155 | 126.52 |
| 205 | 167.52 |
| 255 | 208.06 |

Figure 5:
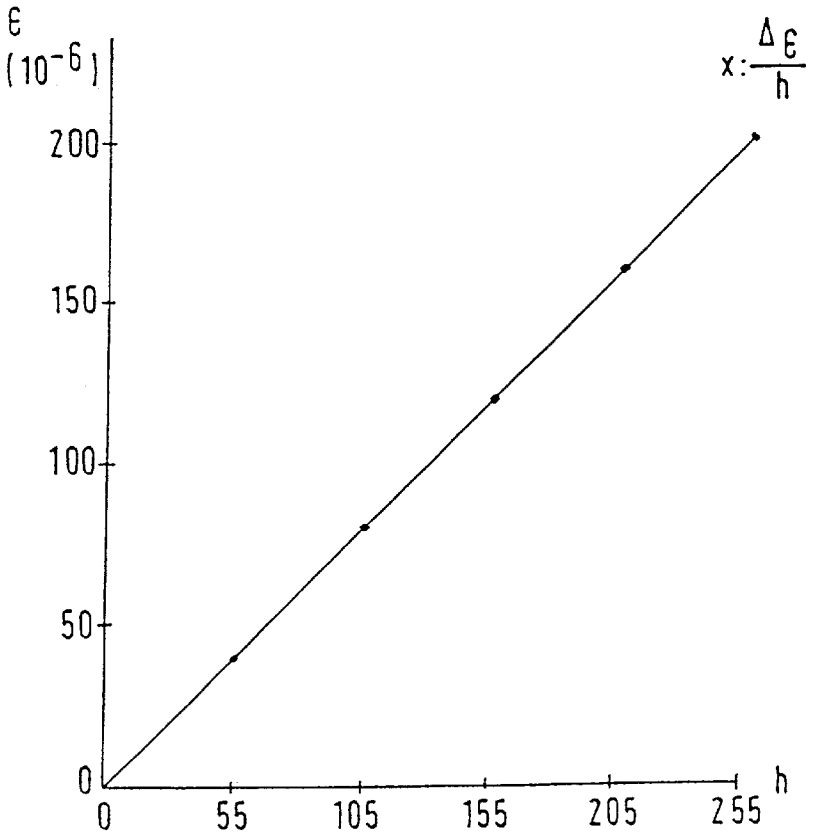
FIG. 5 shows the geometric relationships between looper height h and elongation $\epsilon$.

The results of these calculations are also shown in FIG. 5. It can be seen from FIG. 5 that there is an almost linear relationship between the height h of the top edge of the strip deflection roller 3 and the relative elongation ϵ of the strip center relative to the strip edge for the selected numbers. This relative elongation can be used in rolling to make corrections for flatness.

Figure 6:
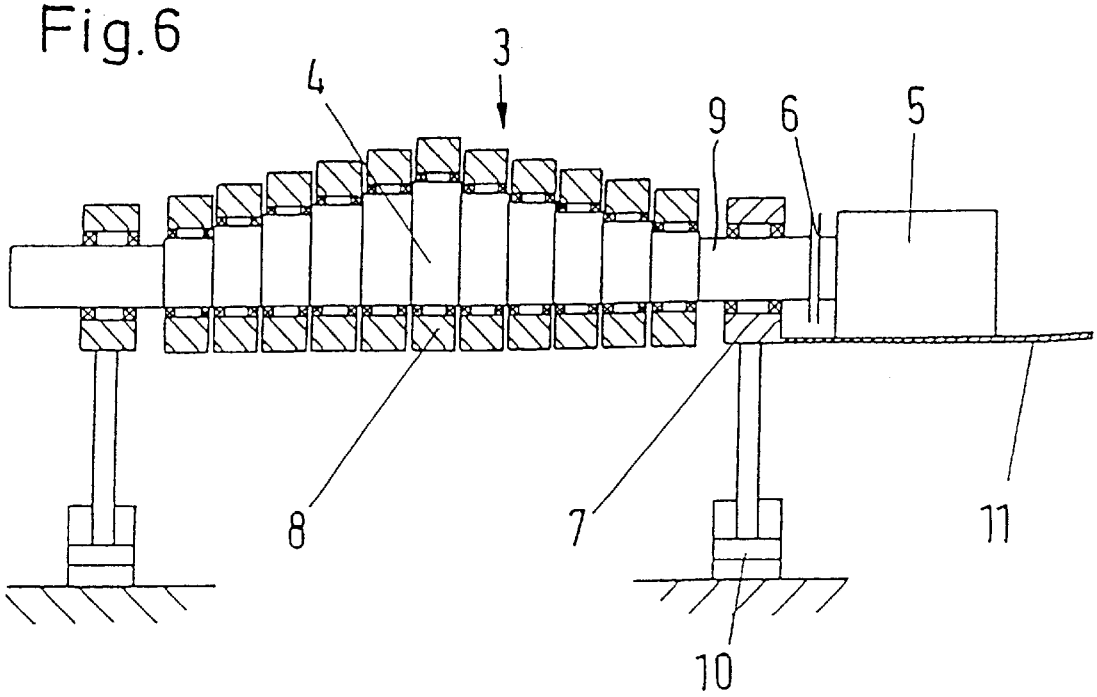
FIG. 6 shows a strip deflection roller according to the invention.

This insight according to the invention is transferred by a strip deflection roller 3 which is used as a tension measuring roller or as a looper in a rolling mill. The strip deflection roller 3 is used between two four-high stands 1 and 2 (FIG. 1) and comprises a disk roller, as it is called, which is shown in FIG. 6. The strip deflection roller 3 is formed by at least five disks 8 which are mounted separately from one another. The special characteristic of this strip deflection roller 3 consists in that each disk 8 can be rotated independently from the others and the respective disk centers are mounted eccentrically on an eccentric shaft 4. The diameters of the disks 8 can be identical, but different disk diameters are also possible as is shown in FIG. 6. The axle 9 of the eccentric shaft 4 is rotatably mounted at 7 and can be rotated continuously by 360 degrees by a stepper motor 5 fastened to the base 11. Accordingly, the outer contour of the strip deflection roller 3 can be adjusted in continuous manner from a concave profile to a parallel profile to a convex profile by the rotation of the stepper motor 5.

In the cold rolling mill, the invention is transferred in that the strip deflection roller 3, as tension measuring roller with adjusting device 10, is moved to a fixed position and the desired flatness correction is adjusted by rotating the looper axle. The flatness correction is limited by the geometry of the strip deflection roller (tension measuring roller) 3, that is, the maximum difference Δh and the adjusted tension load (FIG. 4).

When applied in the hot rolling mill, the strip deflection roller 3 serving as looper roller is not moved to a fixed position, but can be adjusted with respect to height at 10. The looper roller (strip deflection roller 3) serves to compensate for speed differences by forming a strip reserve between the two four-high stands 1 and 2. As a result, there are variations in height of the looper (strip deflection roller 3) and, as is shown in FIG. 5, there are differences in the relative elongation depending on the looper height. These differences can be corrected by means of a continuous correction of the looper profile by the stepper motor 5 corresponding to the looper position in order to influence the flatness and/or the profile of the strip.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A strip deflection roller for matching tension in rolling stock between two roll stands for hot rolling and cold rolling of strip, the strip deflection roller comprising; an eccentric shaft; and at least five adjacent disks mounted on the eccentric shaft so as to be freely rotatable independently, at most two of the disks being mounted concentric to an axis of rotation of the eccentric shaft, remaining of the disks having height positions that are changeable to influence profile and regulate flatness of the strip guided over the strip deflection roller by rotation of the eccentric shaft, the strip deflection roller being movable to a fixed position relative to the strip which is deflected under tension, the eccentric shaft being rotatable so as to adjust a desired flatness correction.

2. A strip deflection roller for matching tension according to claim 1, wherein the disks have a common diameter.

3. A strip deflection roller for matching tension according to claim 1, wherein the disks have different diameters.

4. A strip deflection roller for matching tension according to claim 1, and further comprising a stepper motor fastened to an axle of the eccentric shaft so that the eccentric shaft is driven in rotation continuously.

5. A strip deflection roller for matching tension according to claim 1, and further comprising tension measurement transmitters whereby the strip deflection roller is simultaneously constructed as a tension measuring roller.

6. A strip deflection roller for matching tension in rolling stock between two roll stands for hot rolling and cold rolling of strip, the strip deflection roller comprising: an eccentric shaft having an axle; and at least five adjacent disks mounted on the eccentric shaft so as to be freely rotatable independently, at most two of the disks being mounted concentric to an axis of rotation of the eccentric shaft, remaining of the disks having height positions that are changeable to influence profile and regulate flatness of the strip guided over the strip deflection roller by rotation of the eccentric shaft, the strip deflection roller being adjustable with respect to height position to compensate for speed differences in the two stands, and the eccentric shaft axle being rotatable so as to adjust a desired flatness correction of the strip.

7. A strip deflection roller for matching tension according to claim 6, wherein the disks have a common diameter.

8. A strip deflection roller for matching tension according to claim 6, wherein the disks have different diameters.

9. A strip deflection roller for matching tension according to claim 6, and further comprising a stepper motor fastened to the axle of the eccentric shaft so that the eccentric shaft is driven in rotation continuously.

10. A strip deflection roller for matching tension according to claim 6, and further comprising tension measurement transmitters whereby the strip deflection roller is simultaneously constructed as a tension measuring roller.

* * * * *